US006832604B1

(12) United States Patent
Thompson

(10) Patent No.: US 6,832,604 B1
(45) Date of Patent: Dec. 21, 2004

(54) PNEUMATIC DELIVERY SYSTEM FOR PROJECTILES

(76) Inventor: Paul Thompson, 13601 E. River Rd., Walnut Grove, CA (US) 95690

( * ) Notice: Subject to any disclaimer, the term of this patent is extended or adjusted under 35 U.S.C. 154(b) by 0 days.

(21) Appl. No.: 10/351,098

(22) Filed: Jan. 22, 2003

Related U.S. Application Data

(60) Provisional application No. 60/351,108, filed on Jan. 22, 2002.

(51) Int. Cl.[7] ..... F41B 11/00

(52) U.S. Cl. ..... 124/75; 124/48; 169/9

(58) Field of Search ..... 124/48, 69, 73–75; 169/9, 11, 62, 71, 72

(56) References Cited

U.S. PATENT DOCUMENTS

| | | | | | |
|---|---|---|---|---|---|
| 209,014 | A | | 10/1878 | Babbitt | |
| 314,991 | A | | 4/1885 | Benedict | |
| 344,936 | A | | 7/1886 | Bartlett | |
| 1,204,803 | A | | 11/1916 | McCullough | |
| 1,245,093 | A | | 10/1917 | Doubleday | |
| 2,182,369 | A | | 12/1939 | Barron | 124/30 |
| 2,306,321 | A | | 12/1942 | Roberts | 244/136 |
| 2,960,977 | A | | 11/1960 | Moorhead, Jr. | 124/11 |
| 3,065,798 | A | | 11/1962 | Pearson et al. | 169/36 |
| 3,369,609 | A | | 2/1968 | Fogelgren | 169/31 |
| 3,467,073 | A | * | 9/1969 | Rhodes | 124/75 |
| 3,515,112 | A | * | 6/1970 | Baginski et al. | 124/19 |
| 3,640,263 | A | * | 2/1972 | Rhodes | 124/75 |
| 3,802,407 | A | * | 4/1974 | Imazu | 124/59 |
| 3,823,847 | A | * | 7/1974 | Ware | 222/79 |
| 3,833,064 | A | | 9/1974 | Ranney, Jr. | 169/52 |
| 4,332,234 | A | | 6/1982 | Allen | 124/73 |
| 4,419,936 | A | | 12/1983 | Coates et al. | 102/364 |
| 4,696,347 | A | | 9/1987 | Stolov et al. | 169/46 |
| 5,174,384 | A | | 12/1992 | Herman | 169/70 |
| 5,242,023 | A | * | 9/1993 | Terry et al. | 169/43 |
| 5,415,152 | A | * | 5/1995 | Adamson et al. | 124/59 |
| 5,450,839 | A | | 9/1995 | Nicolaevich et al. | 124/73 |
| 5,496,025 | A | * | 3/1996 | Phillips et al. | 124/56 |
| 5,778,984 | A | | 7/1998 | Suwa | 169/36 |
| 6,318,350 | B1 | * | 11/2001 | Williams | 124/71 |
| 6,439,216 | B1 | * | 8/2002 | Johnson et al. | 124/70 |
| 2002/0166674 | A1 | * | 11/2002 | Kim et al. | 169/52 |
| 2004/0040551 | A1 | * | 3/2004 | Menow et al. | 124/71 |

* cited by examiner

*Primary Examiner*—Jack Keith
*Assistant Examiner*—Troy Chambers
(74) *Attorney, Agent, or Firm*—Sierra Patent Group, Ltd.

(57) ABSTRACT

The disclosed device is directed toward a delivery system comprising a source of pressurized fluid. A discharger is coupled to the source of pressurized fluid. A barrel is coupled to the discharger. A loading mechanism is coupled to the barrel, wherein the loading mechanism includes a chamber disposed in the barrel and a loader is coupled to the chamber and a reloader is coupled to the loader. An elevator is coupled to the barrel. A direction swivel is couple to the source of pressurized fluid.

4 Claims, 19 Drawing Sheets

PNEUMATIC DELIVERY SYSTEM FOR PROJECTILES

CROSS REFERENCE TO RELATED APPLICATIONS

This application is a Utility application which claims priority to an earlier filed U.S. Provisional Application No. 60/351,108, filed Jan. 22, 2002, and expressly incorporates by reference the provisional application

FIELD OF THE INVENTION

The invention relates to the delivery of projectiles over long distances. More specifically, the invention is the method and a device for the pneumatic delivery of a projectile.

BACKGROUND

In many instances, it is desired that firefighters remain at safe distances from a fire. Many times the firefighters are incapable of accessing the fire due to physical barriers and topographic features. As a result, the firefighters efforts are rendered ineffective and the fire is left to its own course resulting in massive damage to forests and property. Homes and structures that lie in the path of wild fires can become isolated and inaccessible to firefighters. Those buildings are abandoned without the aid of fire retardant to shield the building from the wildfire. Those unprotected buildings may be damaged or even burned when the wildfire passes. Fires that erupt in chemical containers, oil/gas fires, high-rise buildings and other inaccessible areas are currently vulnerable to unbridled fire due to the lack of safe access for firefighters and their equipment.

In addition, there is a need to reclaim damaged and deforested remote wilderness after forest fires in order to mitigate soil damage due to erosion. The current approach to erosion control is through manual means, which is cumbersome, time consuming and inefficient. In physically remote areas, erosion control is impractical. Large tracts of land deforested from wildfires are left unprotected and vulnerable to erosion due to the impractical methods that exist in the prior art.

SUMMARY

The disclosed device is directed toward a delivery system comprising a source of pressurized fluid. A discharger is coupled to the source of pressurized fluid. A barrel is coupled to the discharger. A loading mechanism is coupled to the barrel, wherein the loading mechanism includes a chamber disposed in the barrel and a loader is coupled to the chamber and a reloader is coupled to the loader. An elevator is coupled to the barrel. A direction swivel is couple to the source of pressurized fluid.

Another exemplary embodiment is disclosed directed toward a pneumatic delivery system. The pneumatic delivery system comprises an air tank and a barrel mounted to the air tank. A discharge valve is coupled to the barrel proximate to the air tank. The discharge valve has a discharge valve actuator operatively coupled to the discharge valve. A chamber is disposed in the barrel proximate to the discharge valve. A rotary loader is coupled to the chamber distal from the discharge valve. A reloader is coupled to the rotary loader, wherein the reloader provides the rotary loader with projectiles. A moving mount is coupled to the air tank at a base of the air tank. The moving mount includes a swivel table having a hinge mounted to the base and an elevator mounted to the base, wherein the elevator and the hinge provide elevation changes for the barrel. The moving mount further includes a rotor supporting the swivel table and a carriage supporting the rotor, wherein the rotor provides rotation to the barrel for altering a direction of delivery.

Yet another exemplary embodiment is disclosed directed toward a pneumatic delivery system. The pneumatic delivery comprises a charger having a piston disposed in a cylinder. The piston is operatively coupled to a piston actuator. A discharger is operatively coupled to the charger. A barrel is coupled to the discharger distal from the charger. A chamber is disposed in the barrel proximate to the discharger. A loading device is coupled to the chamber.

A method of delivering a projectile with a pneumatic delivery system. The method comprises preparing a projectile for delivery. The method includes loading the projectile into a reloader. Reloading a loader with the projectile from the reloader. The method includes loading the projectile into a chamber from the loader. The method includes actuating a chamber cover, wherein the chamber cover pneumatically seals the projectile in the chamber. The method includes pressurizing a reservoir with pressurized air and releasing the pressurized air from the reservoir impinging on the projectile. The method includes aiming a barrel coupled to the chamber toward an area for delivery of the projectile and launching the projectile from the barrel toward the area for delivery.

DETAILED DESCRIPTION

The present application discloses a device and method for propelling projectiles over long distances, usually inaccessible, for the purposes of delivering projectiles to perform useful work. This projectile can deliver fire retardant and fire extinguishing materials where conventional fire-hose and nozzle arrangements cannot. The device and method can deliver erosion control materials to locations that are remote and inaccessible by manual means. Reforestation of deforested land can also be performed utilizing this device.

Figure 1:
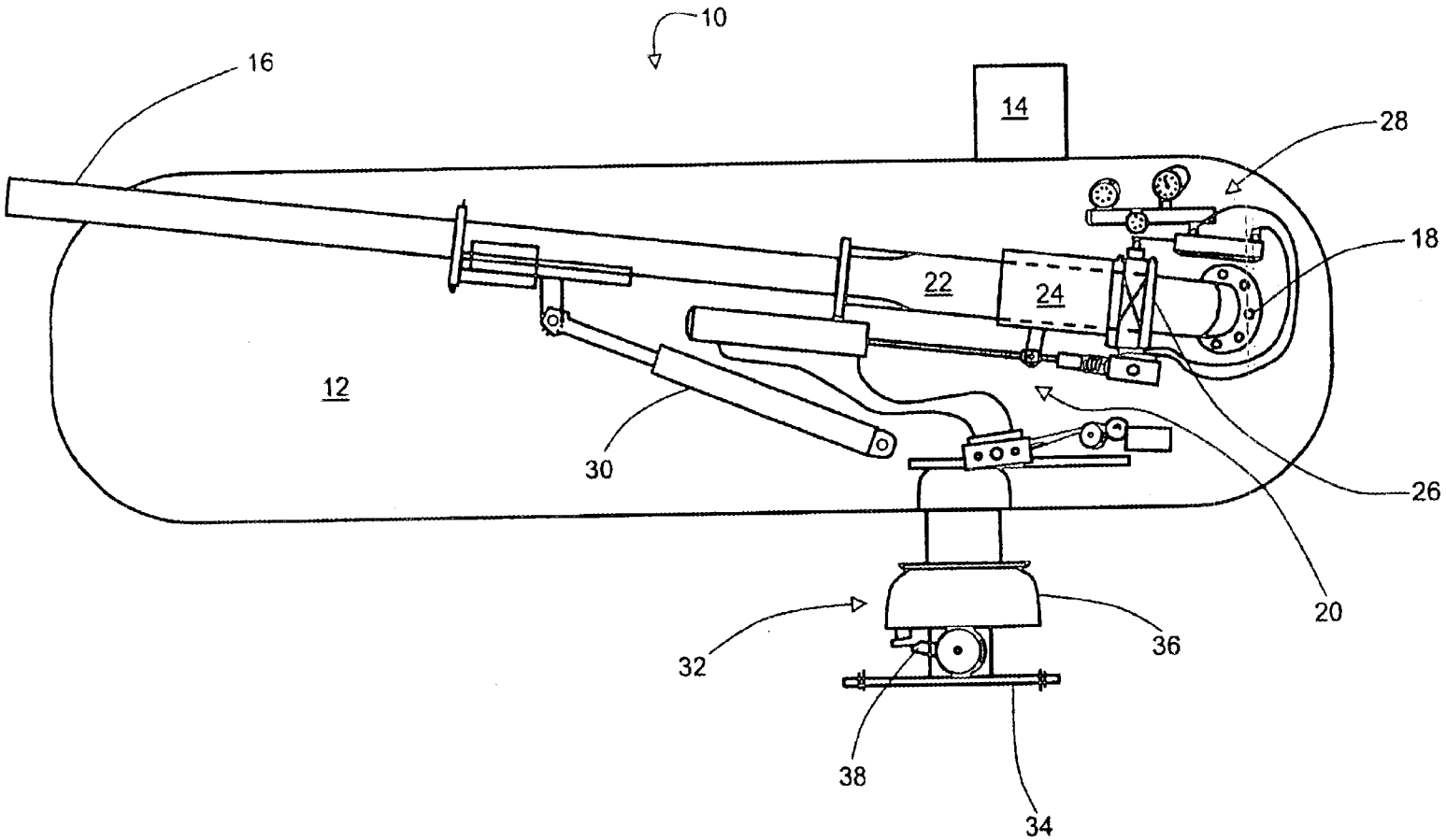
FIG. 1 is a side view of an exemplary embodiment of a pneumatic delivery system.
Figure 2:
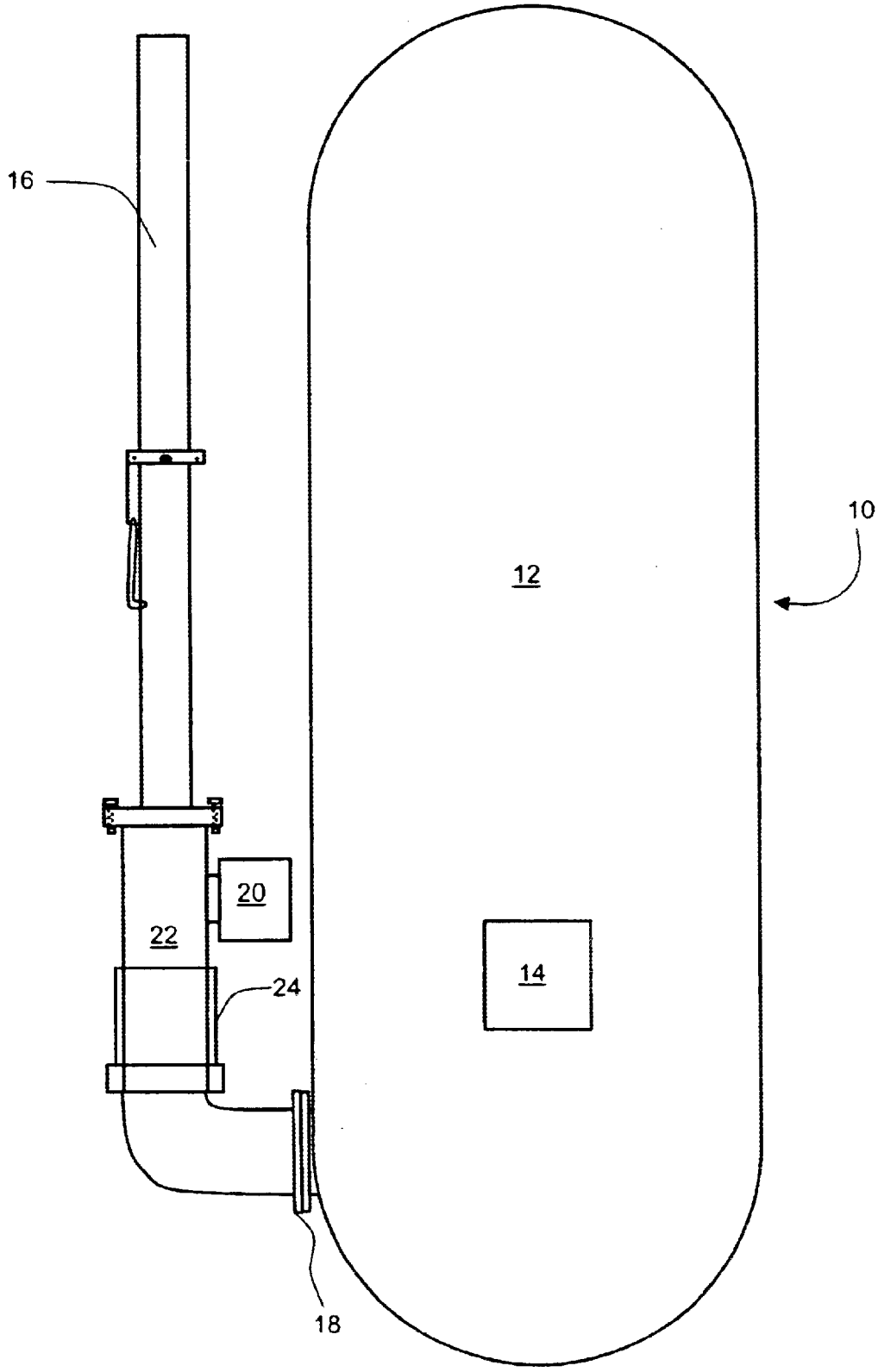
FIG. 2 is a top view of an exemplary embodiment of a pneumatic delivery system.

FIG. 1 illustrates a side view and FIG. 2 illustrates a top view of an exemplary embodiment of a pneumatic delivery system 10. The delivery system 10 includes an air tank or (reservoir) 12 coupled to an air compressor or (means of providing a volume of pressurized air or other working fluid) 14. In one exemplary embodiment the air can be contained at pressures from about 0 pounds per square inch gauge (psig) to about 300 psig. Air pressure in the system can be varied to regulate the effective range. The air tank 12 is coupled to a barrel or (launching tube) 16 via a swivel coupling 18. The barrel 16 and swivel coupling 18, and components attached to the barrel 16, can be attachable with bolted flanges, welded and threadable means, or any combination thereof and the like. The delivery system 10 is not necessarily limited to a single barrel 16, multiple barrels having varying features are also contemplated. The barrel 16 can have rifling or be a smooth bore.

In a preferred exemplary embodiment, barrel 16 can be from about 10 feet to about 25 feet in length, while in other exemplary embodiments the barrel 16 can be up to about 50 feet in length. An inside diameter of about four inches is preferred, while an inside diameter of about two inches to about eight inches is contemplated in other embodiments. In another exemplary embodiment, the barrel 16 is capable of having the barrel length altered.

One exemplary embodiment utilizes constructing the barrel 16 in multiple pieces such that the pieces can be dismantled to reduce the overall barrel length. This configuration can be useful for transporting the delivery device 10. The barrel 16 can have mating flanged connections that are coupled together to make a full barrel length and decouple for transportation. Other forms of barrel length adjustment include barrel extensions, telescopic features, hinged and threadable elements, and the like.

As shown in FIGS. 1 and 2 the barrel 16 includes a loading mechanism 20 and chamber 22 sealable by a chamber cover 24 in operative communication with the loading mechanism 20. A main valve 26 and valve actuator 28 coupled with the barrel 16 function to contain and release the pressurized air from the air tank 12 to the atmosphere through the barrel 16. The main valve 26 is actuated through valve actuator 28. The main valve 26 can be any style of fast actuating valve that provides sufficient air seal at the valve seating surfaces, such as butterfly valves, gate valves, ball valves, and the like. Valve actuator 28 is operatively coupled to the air main valve 26 and can include pneumatic, electric, and hydraulic actuators, as well as manual actuators. The barrel 16 is coupled to a means for moving the barrel elevation and direction in order to aim the delivery system 10 to deliver a projectile (not shown) on target. The means for adjusting the barrel elevation can be elevator 30 that can be actuated via manually driven actuators, pneumatic, hydraulic, or electrically driven actuators. The elevator 30 adjusts the elevation of the barrel 16 by rotating the barrel 16 relative to the swivel coupling 18 fixed to air tank 12. The barrel 16 changes elevation or (stated another way) is directed upwardly or downwardly, thus increasing the trajectory or decreasing the trajectory of the launching direction. The means for moving the barrel direction can be a variety of means including a direction swivel 32, a rotating base, as well as a wheeled chassis or vehicle mountable to the delivery system 10.

The exemplary embodiment illustrated in FIG. 1 includes a direction swivel 32 that can comprise a swivel base 34 which can be mountable to a vehicle, a chassis or other mounting structure fixed or mobile (not shown). The swivel base 34 is coupled to a swivel housing 36 which includes rotating means and structure for providing degrees of rotation to the delivery system relative to the swivel base 34, such that the barrel 16 can be rotated like a turret in order to change the launching direction out of the barrel 16 from side to side. The direction swivel 32 further includes actuation means 38 for imparting rotation to the swivel housing 36 relative to the swivel base 34. The rotation actuation means 38 can include air cylinders, hydraulic actuators, mechanical gearing, brakes, and the like.

Figure 3:
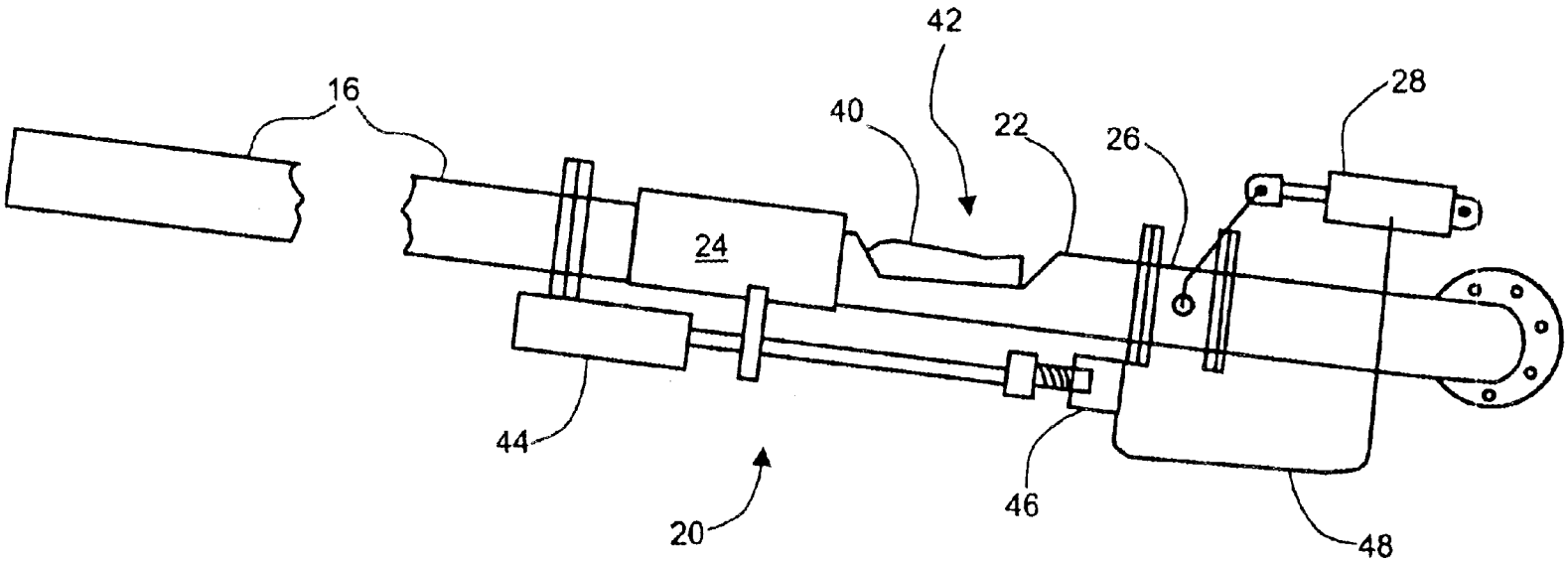
FIG. 3 is a side view of an exemplary embodiment of a barrel, chamber and air valve.
Figure 4:
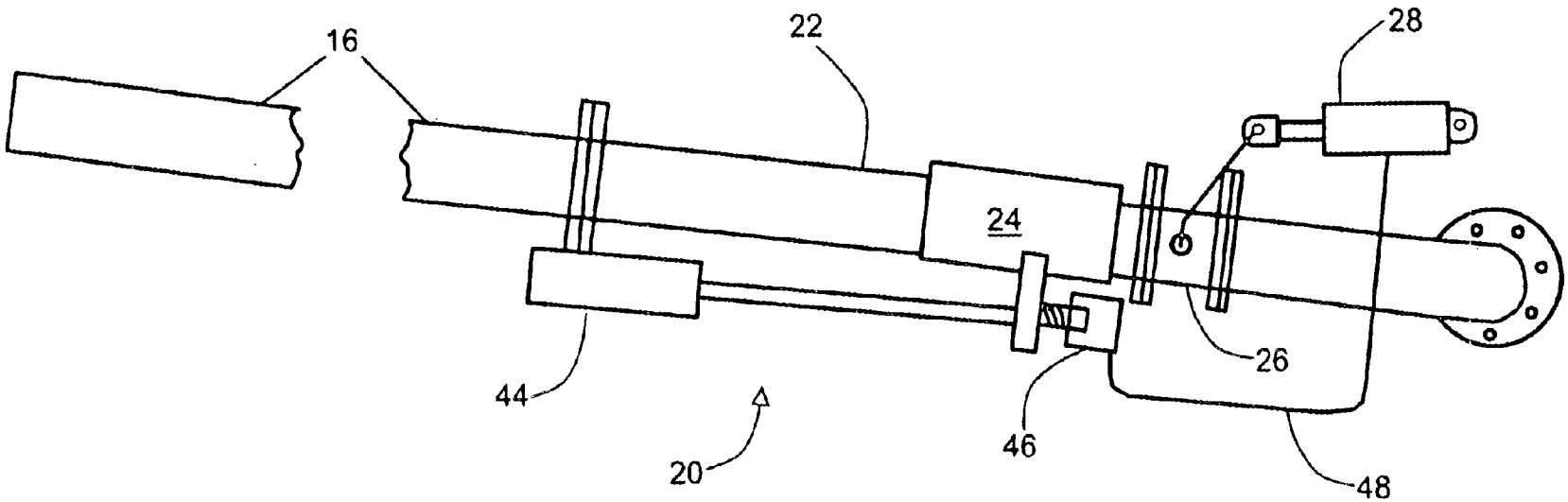
FIG. 4 is a side view of another exemplary embodiment of a chamber and air valve.

FIGS. 3 and 4 illustrate an exemplary embodiment of the barrel 16 and the loading mechanism 20, the chamber 22 and the main valve 26 having a valve actuator 28. The chamber 22 is mountable with the barrel 16. In one exemplary embodiment, the barrel 16 and the chamber 22 are contiguous. The chamber 22 is a structure that facilitates the loading and subsequent containment of articles that can be delivered to remote locations such as a projectile 40. The chamber 22 can be substantially cylindrical similar to the shape of the barrel 16. The chamber 22 has an opening 42 that receives articles that can be delivered to remote locations, such as the projectile 40. The chamber 22 is opened and closed by the use of the chamber cover 24. The chamber cover 24 is mounted on the outside of the chamber 22 and translates along the outer surface of the chamber 22. The chamber cover 24 is slidable along the outside diameter of the chamber 22 such that the chamber 22 is moved over the opening 42 and sealed closed. The chamber cover 24 is moved to uncover the opening 42 to allow loading. The chamber cover 24, in one exemplary embodiment, is a brass cylinder with at least two o-rings fitted into slots or grooves (not shown) formed on the inside diameter of the chamber cover 24. In an another exemplary embodiment, there is an o-ring at opposite ends of the chamber cover 24 to seal the opening 42 of other chamber. The o-rings form a seal between the chamber cover 24 and the chamber 22 preventing air leakage. In another exemplary embodiment, the o-ring can be mountable on the outside diameter of the chamber 22 and located at opposite ends of the opening 42 to seal the opening 42.

A chamber cover actuator 44 is coupled to the chamber cover 24. The chamber cover actuator 44 provides the means for moving the chamber cover 24 along the chamber 22 to open and close the chamber 22. A first control valve 46 is operatively coupled to the chamber cover actuator 44. The first control valve 46 indicates the position of the chamber cover 24 and actuates the valve actuator 28 via control line 48. The control line 48 is pneumatic in the exemplary embodiment shown, however, electronics and the like can be used as well. Multiple control lines 48 can also be used. In other exemplary embodiments, the first control valve 46 can be operatively coupled to the chamber 22.

Still referring to FIGS. 3 and 4, the operation of the exemplary embodiment of the chamber 22 and loading mechanism 20 can be described. The loading mechanism 20 is activated by controls to be discussed herein below. The chamber cover actuator 44 is the primary motive force for the actuation of the chamber cover 24. It is illustrated as a pneumatic piston/cylinder, however it can be electrically driven or hydraulically driven or any combination thereof. When chamber cover actuator 44 is actuated to close the chamber cover 24, the piston is extended resulting in linear motion of the chamber cover 24 to sealably cover the opening 42. As the chamber cover 24 reaches a seated position, meaning that it is completely closed over the opening 42 and seals the opening in an air tight fashion (as shown in FIG. 4) the first control valve 46 is activated. The first control valve 46 can be activated mechanically as shown in FIG. 4, as well as being electronically activated through limit switches, sensors, and the like. Upon activation, the first control valve 46 actuates the valve actuator 28 via control line 48. In the exemplary embodiment shown, the actuation is pneumatic, however, other mechanical means such as control arms and hydraulic actuation, as well as electronic actuation is contemplated. Main valve actuator 28 actuates main valve 26. Main valve 26 can be closed at a point in time just before the projectile 40 exits the barrel 16, so that the pressurized air is conserved and the air tank does not have to be recharged as frequently.

Figure 5:
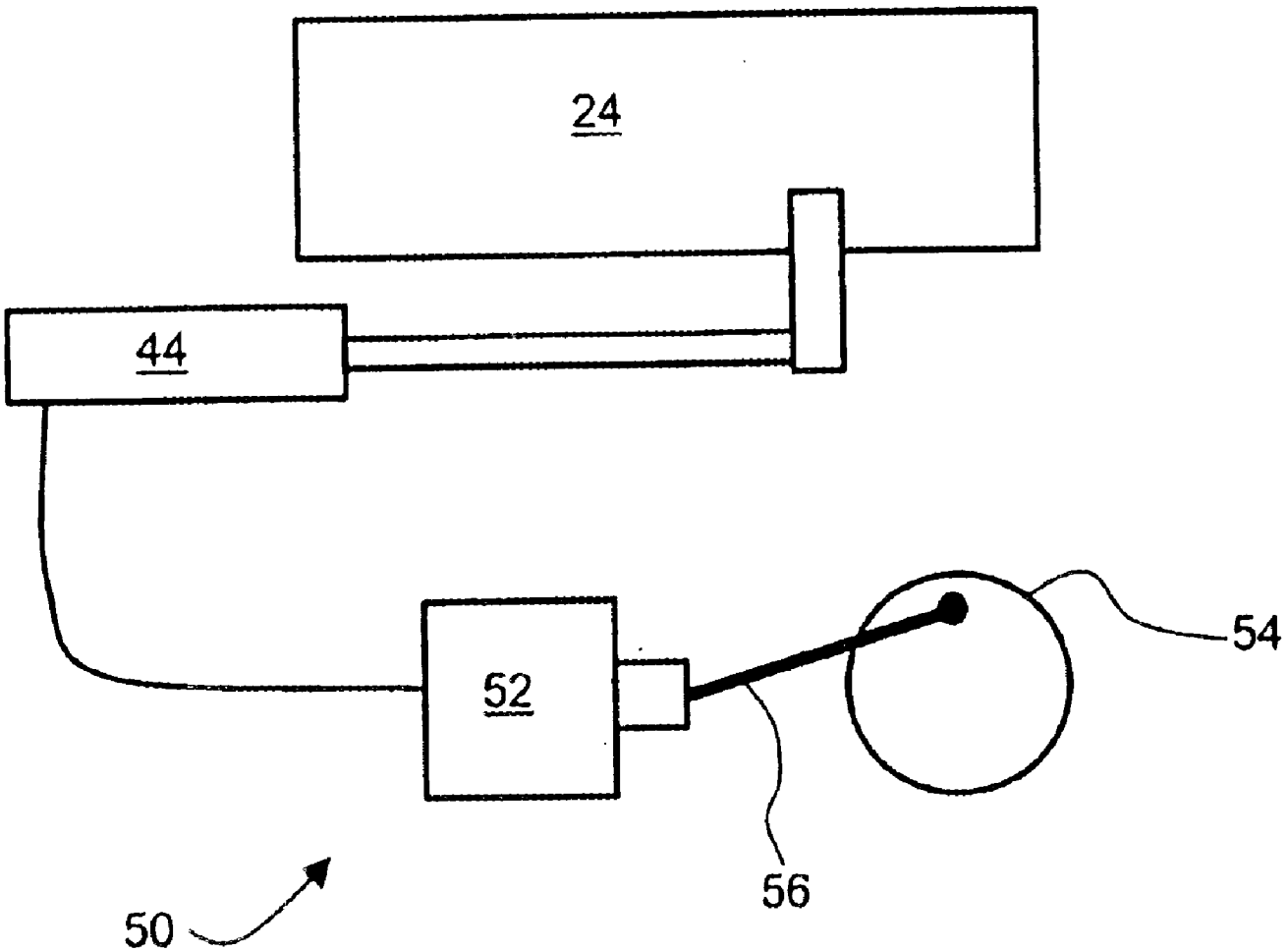
FIG. 5 is a schematic representation of an exemplary embodiment of the chamber cover.

FIG. 5 illustrates an exemplary embodiment of the chamber cover actuator 44 and associated chamber cover actuator controls 50. As discussed above, the chamber cover 24 is operatively coupled to a chamber cover actuator 44. The chamber cover actuator 44 is operatively coupled to a second control valve 52. The second control valve is operatively coupled to a timing motor 54. Timing motor 54 can be an adjustable speed motor both alternating current and direct current. In the exemplary embodiment shown, the timing motor 54 rotates and translates a rod 56 that actutes second control valve 52. As the second control valve 52 is actuated, a control signal is sent to chamber cover actuator 44, and actuates the chamber cover actuator 44. The timing motor 54 can vary the rate of rotation that results in faster or slower actuation of the chamber cover actuator 44 and subsequently the rate of opening and closing the chamber cover 24. The chamber cover actuator 44 can be controlled electronically or mechanically. The rate at which the system can deliver projectiles is related to the speed the valve operates or cycles open or closed. In the exemplary embodiment shown, the rod 56 acts similar to a crank to move the second control valve 52 such that the second control valve 52 opens in one direction and closes in another direction. In other exemplary embodiments, electronic controllers can be employed in the loading mechanism 20. Processors and other such timing mechanisms can be employed to provide control functions to open and close the chamber cover 24.

Figure 6:
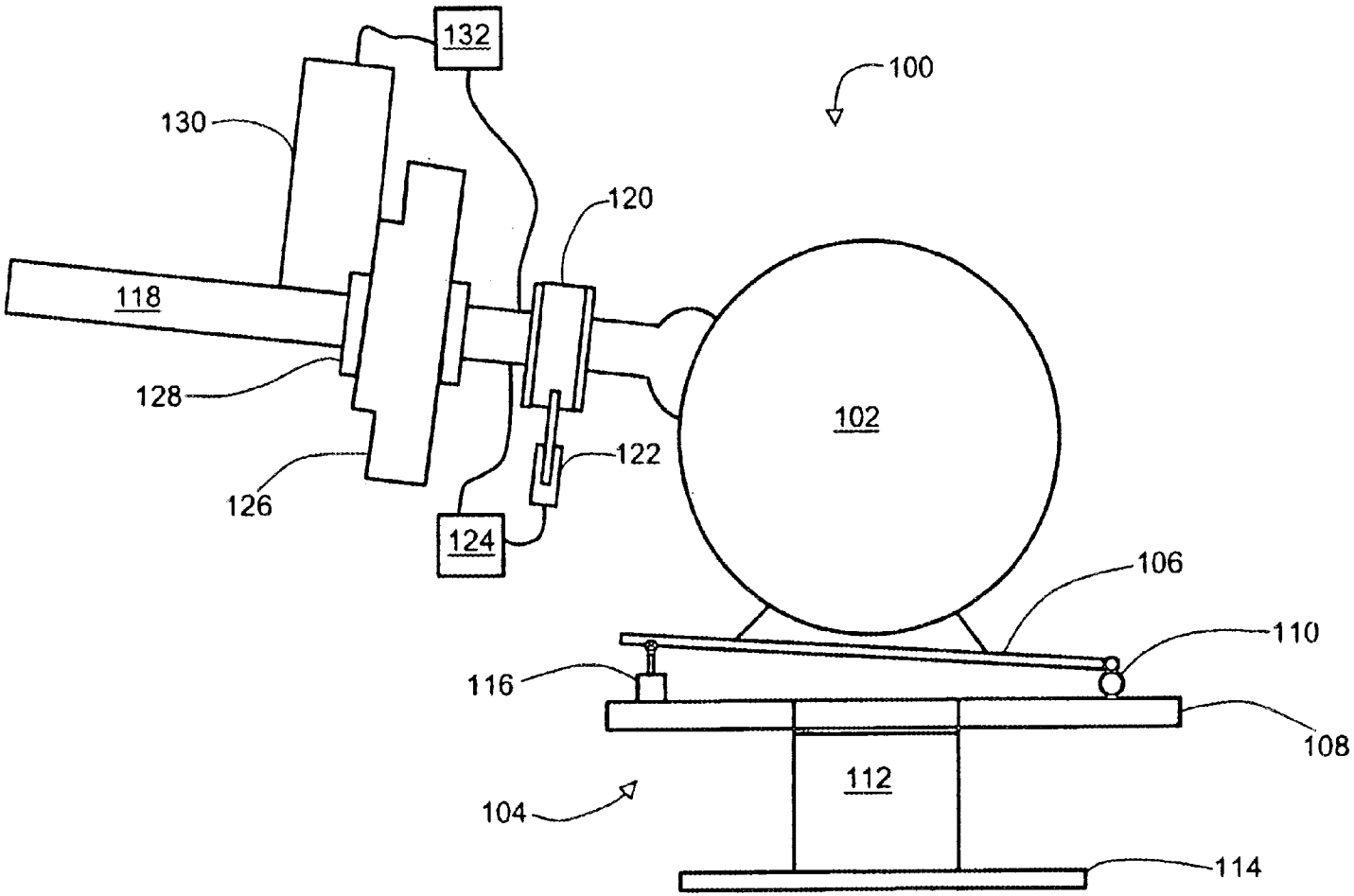
FIG. 6 is a side view of another exemplary embodiment of a pneumatic delivery system.

FIG. 6 illustrates another exemplary embodiment of the delivery system 100. In this exemplary embodiment, the air tank 102 (reservoir) is mountable on a moving mount 104 that has both rotational and translational degrees of freedom, such that the delivery system 100 can alter the range, trajectory and the direction of the delivery of the projectile (not shown). A base 106 is hinged to a swivel table 108 via hinge 110. The swivel table 108 is rotatably mounted on a rotor 112 that is mounted to a carriage 114. As with the previous exemplary embodiment, the carriage 114 can be fixed or mobile and coupled to various motive devices, such as trucks and trailers. By these arrangements the delivery device 100 is capable of transporting to remote areas, as well as being located near hazardous areas for deployment. The base 106 is hinged about hinge 110 and provided with an elevator 116 operatively coupled between the swivel table 108 and the base 106. The elevator 116 can elevate the base 106 relative to the swivel table 108 to provide a change in the trajectory of the projectile. The rotor 112 can rotate about a substantially vertical axis to provide a change in the direction of the projectile (e.g. from side to side in a sweeping path). In this exemplary embodiment, the barrel 118 is directly fixed to the air tank 102 and has no need of a swivel joint or movable coupling, as disclosed in the exemplary embodiment of FIG. 1. The barrel 118 and air tank 102 move in unison upon the base. A discharge valve 120 is provided with a discharge valve actuator 122 and discharge controls 124 all operatively coupled to provide for the rapid release of compressed fluid (air) to launch the projectile. A rotary loader 126 is mountable on the chamber 128 of the barrel 118 proximate to the discharge valve 120. A reloader 130 is mountable on the barrel 118 proximate to the rotary loader 126. A loading controller 132 can be operatively coupled to the reloader 130 and the discharge controls 124, such that a sequential reloading of the delivery system 100 can be provided. In this exemplary embodiment, the rotary loader 126 enables loading of the projectile and sealing of the chamber 128 prior to launching the projectile. The rotary loader 126 can provide timed loading and unloading means through rotary motion. The exemplary embodiment can employ many of the same features as the previous exemplary embodiment described above.

Figure 7:
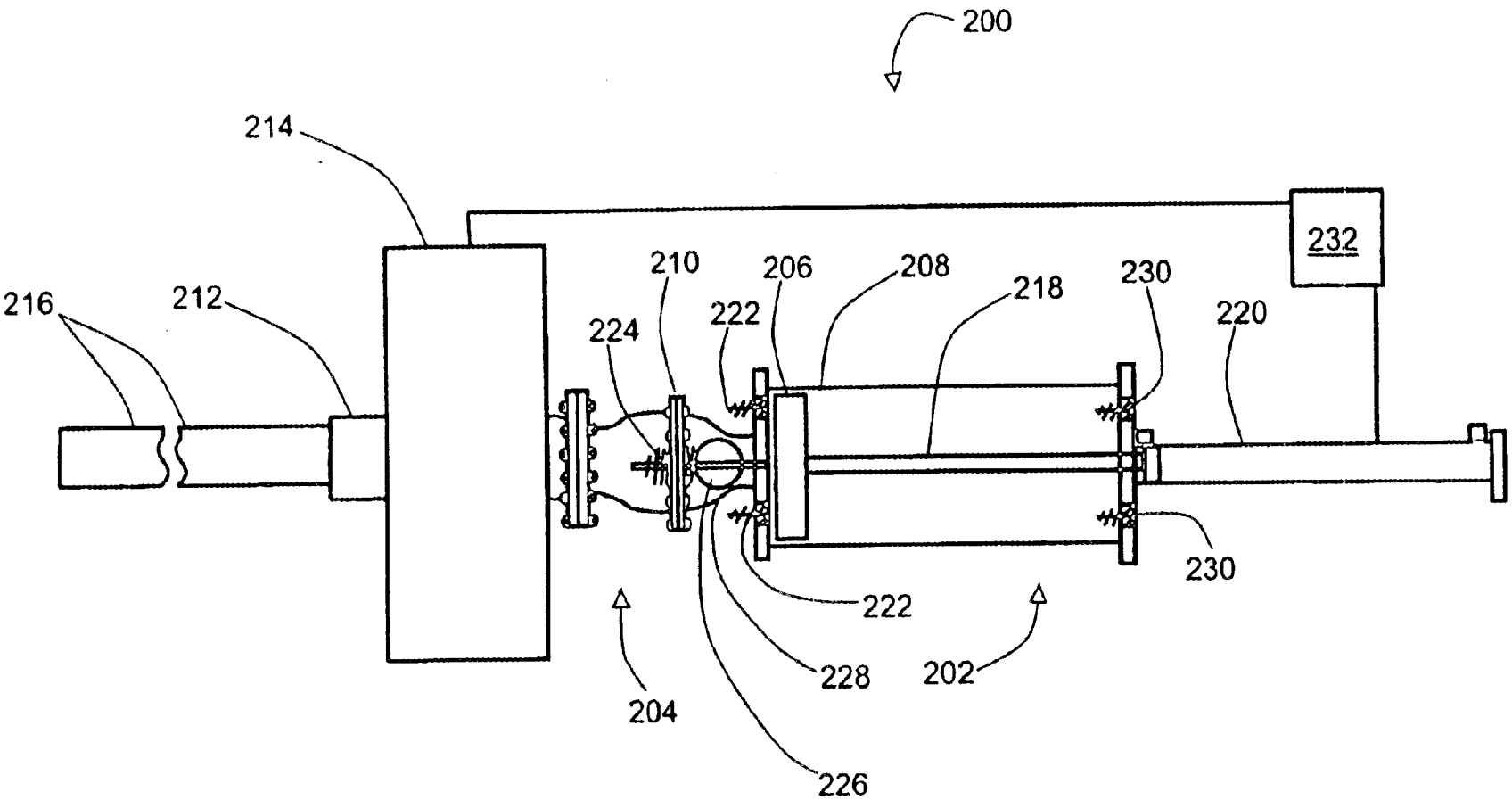
FIG. 7 is a top view of yet another exemplary embodiment of a pneumatic delivery system.

FIG. 7 illustrates another exemplary embodiment of a delivery system 200 without the use of large air reservoir or tank or a separate air compressor. This exemplary embodiment includes a means for producing a high-pressure fluid (air) charge or simply a charger 202 and a means for releasing the high-pressure fluid (air) charge or simply a discharger 204. The charger 202 can include a piston 206 and cylinder 208 arranged in fluid communication with a valve means or simply release valve 210 that communicates with the chamber 212, loading device 214 and the barrel 216. The charger 202 can include the piston 206 disposed in the cylinder 208 with a drive rod 218 coupled to the piston at one end and a means of motive force or simply piston actuator 220 opposite thereof. A hydraulic ram and a press are all examples of a piston actuator 220. The cylinder 208 can be fitted with air inlet valves 222 that allow for air recharge air pressure charging and rapid piston retraction. The piston 206 can communicate with the release valve 210 such that the piston 206 actuates the release valve 210 to discharge the pressurized fluid (air). In the exemplary embodiment illustrated at FIG. 7, the release valve 210 is a ball check valve arrangement with a biasing member 224 positively seating a ball 226 in the valve seat 228. The release valve 210 is positioned, such that the piston actuates the release valve 210 when the piston 206 extended by the rod 218 drives the ball 226 away from the valve seat 228, thus unseating the ball 226 and opening the release valve 210, such that the pressurized fluid (air) can escape from the cylinder 208 and enter the chamber 212. Alternate valve arrangements are also contemplated. When the piston 206 is retracted the air inlet valves 222 located on the cylinder 208 allow for fluid (air) to refill the cylinder 208 and air outlet valves 230 low for the fluid (air) to escape from behind the piston 206 on the rearward stroke of the piston 206 to allow for less air pressure behind the piston 206 and a more rapid piston movement on the backstroke. By varying the size of the cylinder 208 and the length of the piston stroke, the air charge can be controlled and subsequently the delivery of the projectile can be controlled. The larger the charger 202 (e.g. the piston and cylinder arrangement), the larger the volume and pressure of the charge of air. As with the above disclosed exemplary embodiments, a control means or simply a controller 232 can be coupled to the loading device 214 and the piston actuator 220 (shown as a rotary loader in FIG. 7) other loaders are contemplated. The rate of reloading and subsequent delivery of the projectile can be varied. Multiple delivery systems 200 can be arranged, such that rapid fire delivery as well as multiple target acquisitions can be accomplished. The delivery system 200 can be mountable on a fixed mount or a portable mount as well as a variety of targeting and trajectory devices (not shown).

Figure 8:
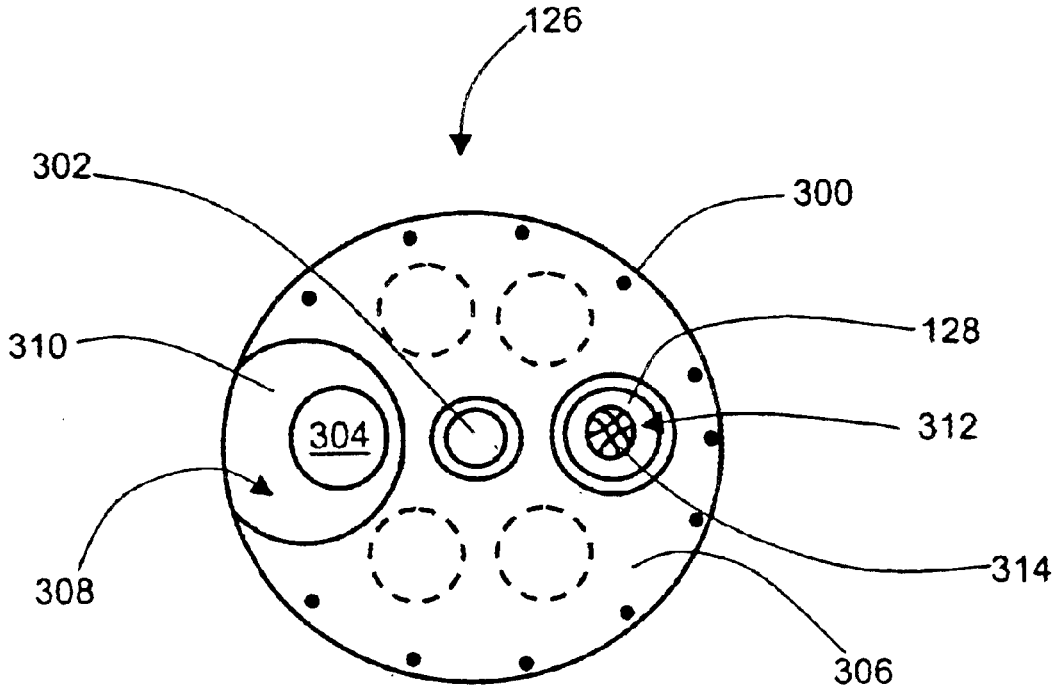
FIG. 8 is a front view of an exemplary embodiment of a rotary loader.

FIG. 8 illustrates a front view of an exemplary embodiment of the rotary loader 126 as shown in FIG. 6. The view illustrates a cylinder 300 formed rotatable about a central bearing 302 and at least one cell 304 (preferably six cells 304) for holding and transporting the projectile or containers 40 to be launched. A first circular plate 306 encloses one end of the cylinder 300 and has a cutout 308 for communication with a reloader 130 (see FIGS. 6, 9 and 10). A second plate encloses the cylinder 300 to cover the end opposite the first plate 306. The first and second plates 306, 310 can be coupled to the central bearing 302 in any suitable manner such as welding, bolting and the like. The cylinder 300 is enclosed and rotates about the central bearing 302. A passage 312 through the first plate 306 and the second plate 310, such that the passage 312 is aligned for communication with the chamber 128 and/or the barrel 118. In the exemplary embodiment shown at FIG. 8, the passage 312 is opposite the cutout 308 on the first plate 306. The cells 304 of the cylinder 300 rotatably align with the cutout 308 or the passage 312. As the cylinder 300 rotates about the central bearing 302, the cells 304 come into alignment with the passage 312 or the cutout 308. When the cells 304 are loaded with projectiles 40, adjacent the cutout 308, they are subsequently rotated into alignment with the passage 312, which is aligned with the chamber 128 and/or the barrel 118. In this manner, the empty 304 can be placed into communication with the reloader 130 for loading, as well as placed into communication with the chamber 128 for delivery through the barrel 118. A means for unloading the projectile 40, such as a plunger 314, can be in operable communication with the passage 312 and the chamber 128 and/or barrel 118. In the exemplary embodiment shown, the plunger 314 can translate through the passage 312 to unload the projectile 40 in a cell 304 aligned with the passage 312. Actuation of the plunger 314 can be by pneumatic piston, hydraulic piston, manual mechanical means, and the like. The cylinder 300 can be actuated with a step motor, a timed motor, or by mechanical means, as well.

Figure 9:
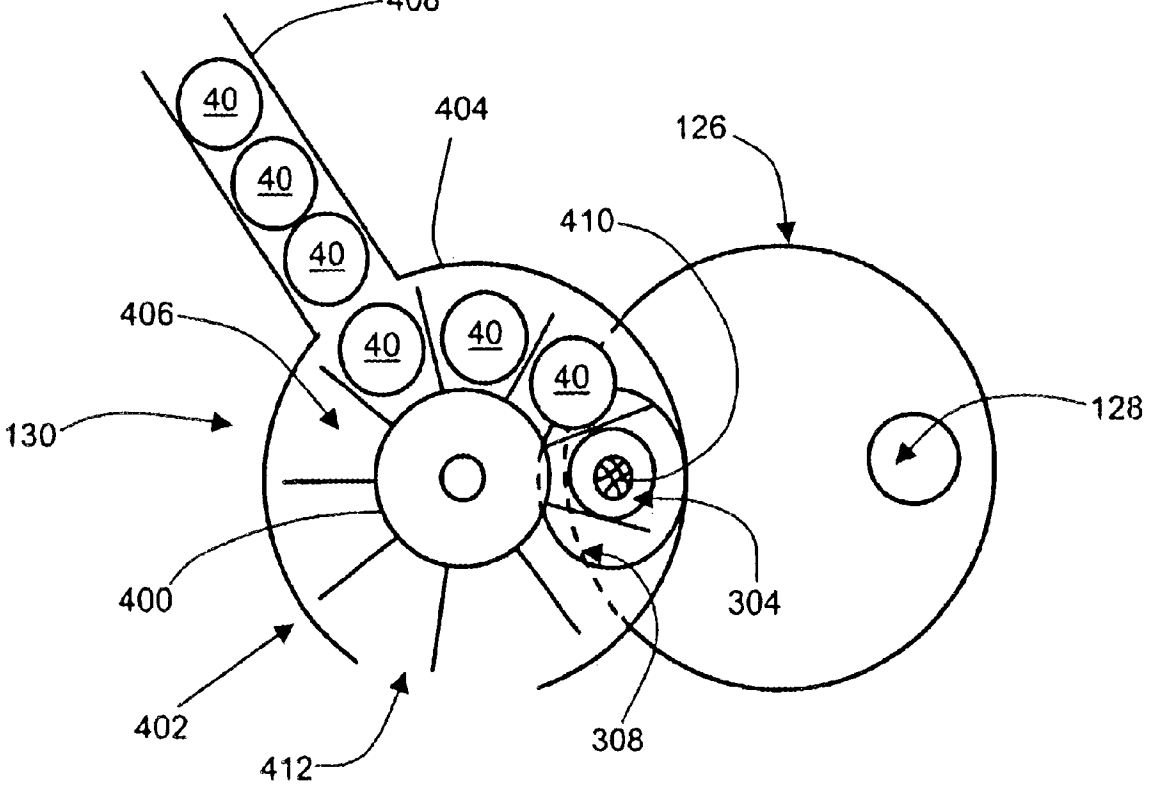
FIG. 9 is a front view of an exemplary reloader interfacing with an exemplary rotary loader.

FIG. 9 illustrates a front view of an exemplary reloader 130 interfacing with the rotary loader 126. The reloader 130 has a rotatable cylinder or drum 400 with paddles 402 fixed about the outer diameter of the drum 400. An enclosure 404 encloses the drum 400 to contain and guide projectiles 40 that are guided to the apertures or chambers or simply channels 406 formed by the drum 400, paddles 402 and enclosure 404. Projectiles 40 can be loaded through a guide chute 408 in single file and then enter the vacant channel 406. The projectile 40 is carried in the channel 406 about the drum 400 until the projectile 40 is in communication with the cutout 308 of the rotary loader 126. A loading means or push rod 410 is used to push the projectile 40 into a cell 304 of the rotary loader 126. For example, a plunger on a rod can be used for the push rod 410 and can be actuated pneumatically to extend and push the projectile 40 out of the channel 406 and into the empty cell 304 of the rotary loader 126. In the event that projectiles 40 leak or break apart, an aperture 412 is formed in enclosure 404 to allow for debris to be removed to clear the channels 406. Multiple channels 406 and duplicate reloaders 130 can be provided for more rapid reloading.

Figure 10:
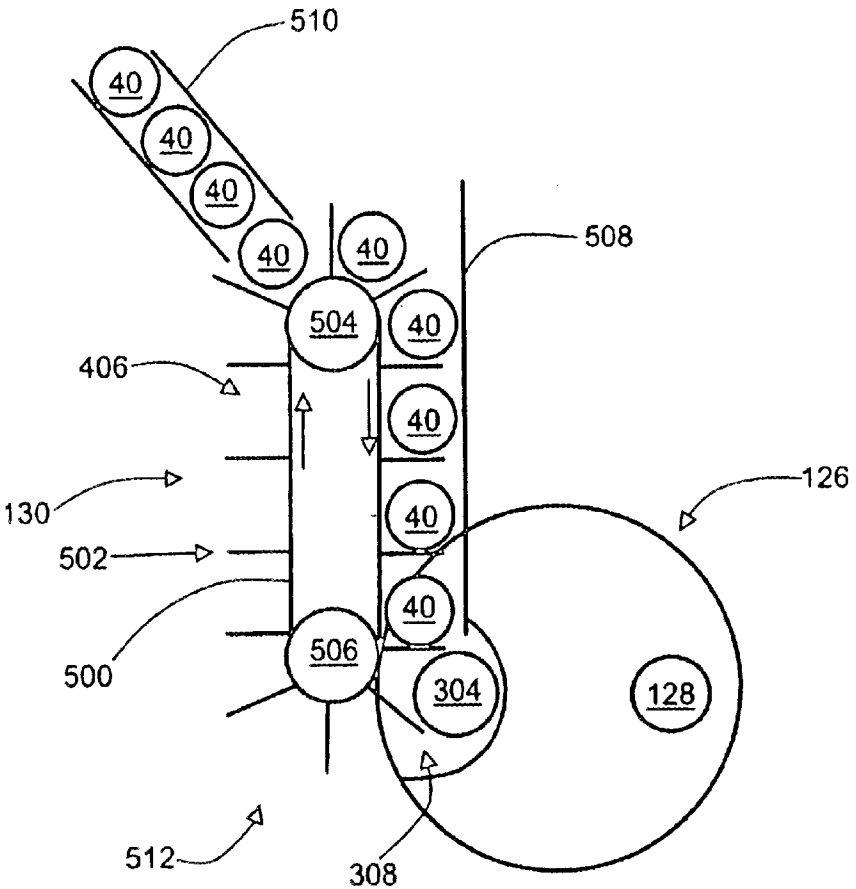
FIG. 10 is a schematic of another exemplary embodiment of a reloader.

FIG. 10 illustrates another exemplary embodiment of the exemplary reloader 130 from FIG. 9. In this exemplary embodiment, a drive belt 500 with paddles 502 affixed to the drive belt 500 rotates about two discs, cylinders or pulleys, a drive pulley 504 and a guide pulley 506. The paddles 502 are encased by a casing 508 to form channels 406 that can be used to transport projectiles 40 into the rotary loader 126. A gravity feeder 510 can guide the projectiles 40 into the channels 406 formed by the drive belt 500, paddles 502 and casing 508. The channels 406 deposit the projectiles 40 in proximity to the cutout 308 aligned with the cell 304. As in the exemplary embodiment shown in FIG. 9, a loading means moves the projectile 40 from the channel 406 into the cell 304. Even a gravity impelled loading means is contemplated. The drive belt 500 can be driven by motors or other rotary means to propel the channels 406 holding the projectiles 40 to the rotary loader 126 in a timed manner. In this exemplary embodiment, the portion of the casing proximate to the cutout is open to serve as a cleanout 512 for the removal of unwanted debris from the channels 406.

Figure 11:
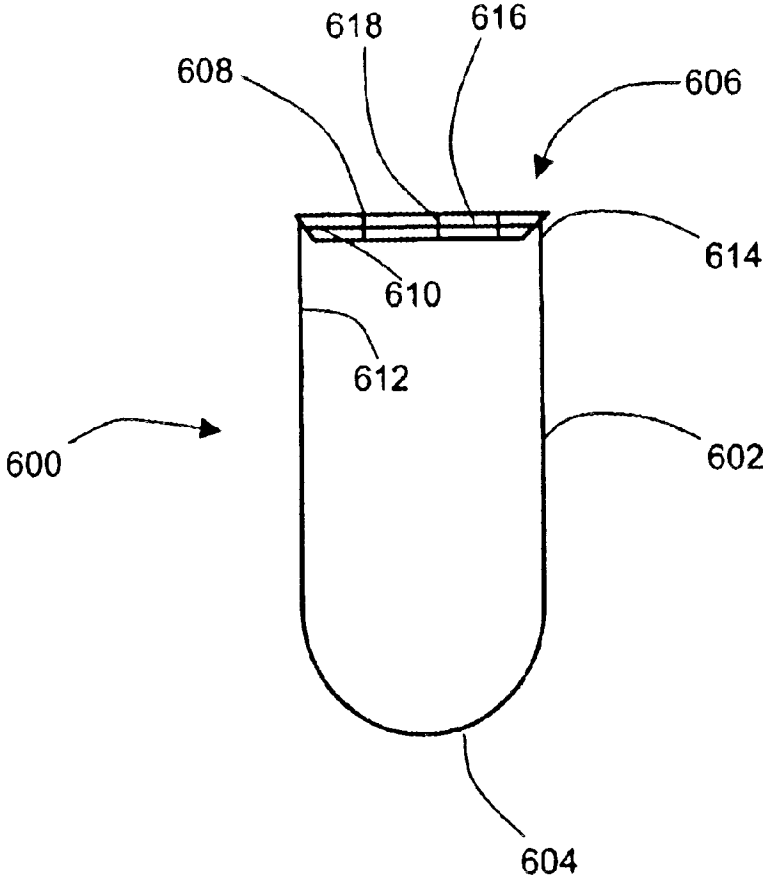
FIG. 11 is a side view of an exemplary embodiment of a container.

FIG. 11 illustrates an exemplary embodiment of a projectile in the form of a container 600. It is also contemplated that a variety of projectiles be employed with the delivery device (e.g., cylinders and spheres). As an example, container 600 is shown to provide features of the exemplary embodiment. The container 600 can have a substantially cylindrical shape formed by side wall 602 converging into a bottom 604 conical in shape and an opening 606 shaped to receive a lid 608. The side wall 602 can have fitting 610 disposed on an inner surface 612 of the side wall 602 proximate the opening 606. The lid 608 can be a disc shape having a rim 614 with a receiver 616 that mountably couples with the fitting 610. In one exemplary embodiment, the fitting 610 can be a ridge shape and the receiver 616 can be a groove shape, such that the ridge and groove mate to form a sealed connection. The rim 614 is structurally rigid to resist deformation as a result of forces from launching the container from the delivery system. In some exemplary embodiments, reinforcement members (or ribs) 618 can be integrated into the lid 608 to further stiffen the lid 608. The lid 608 can be made of various materials, such as cardboard, plastics, rubber, cloth, and the like.

Figure 12:
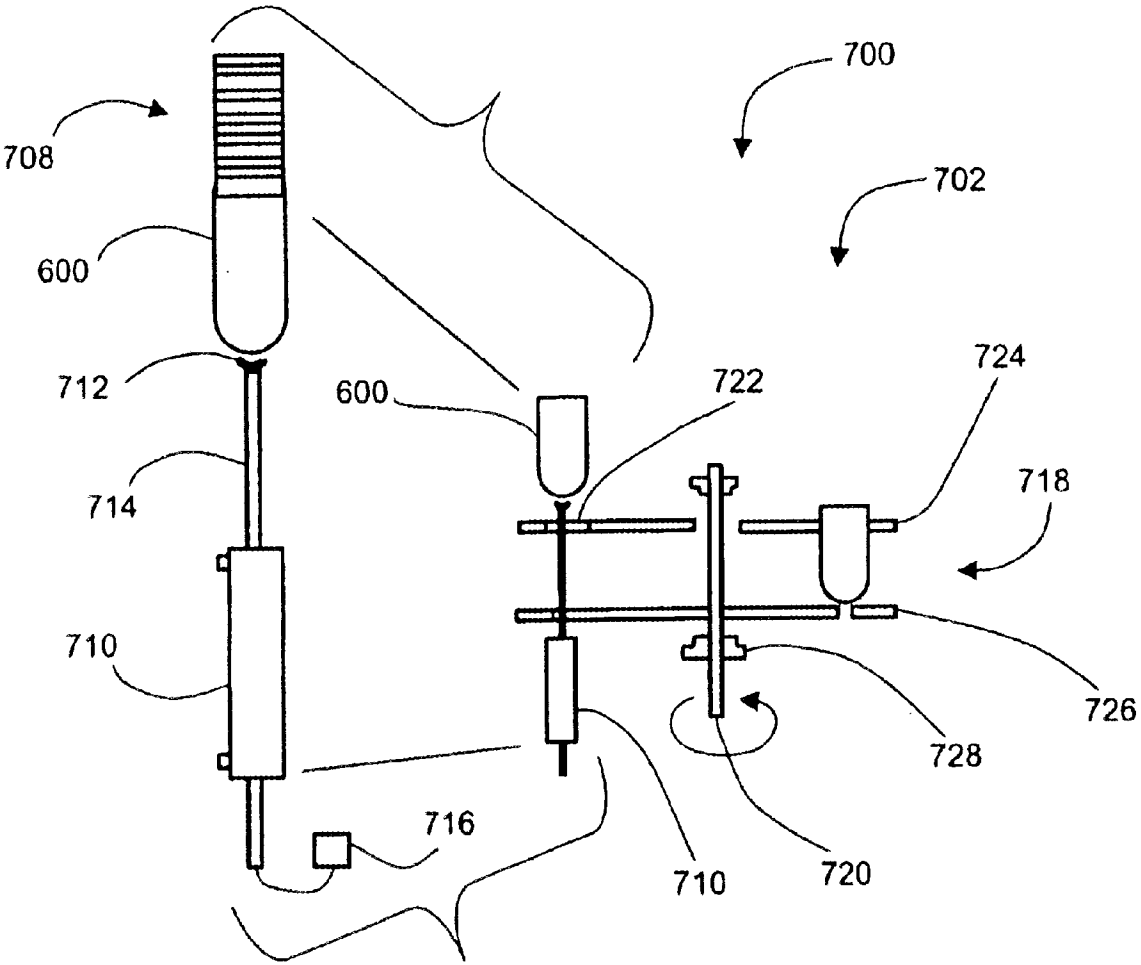
FIG. 12 is a schematic of an exemplary embodiment of a container collection station.
Figure 13:
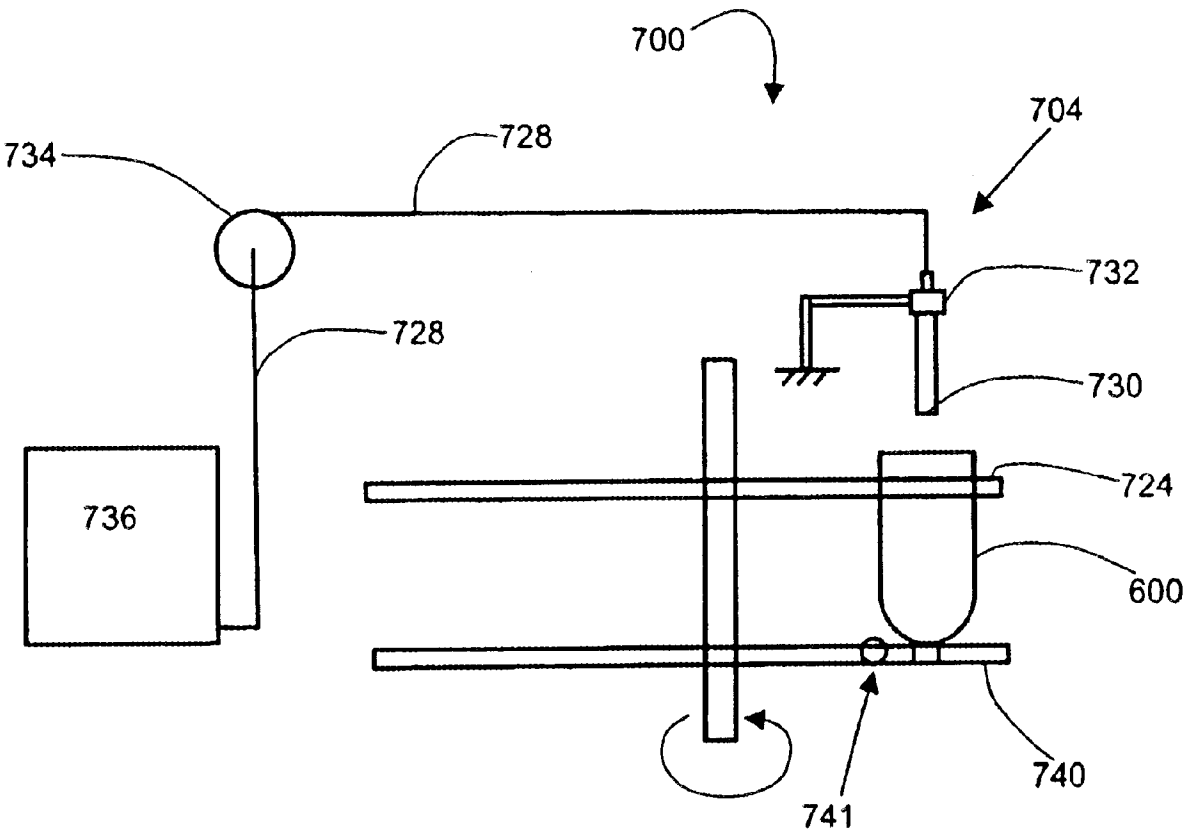
FIG. 13 is a schematic of an exemplary embodiment of a container filling station.
Figure 14:
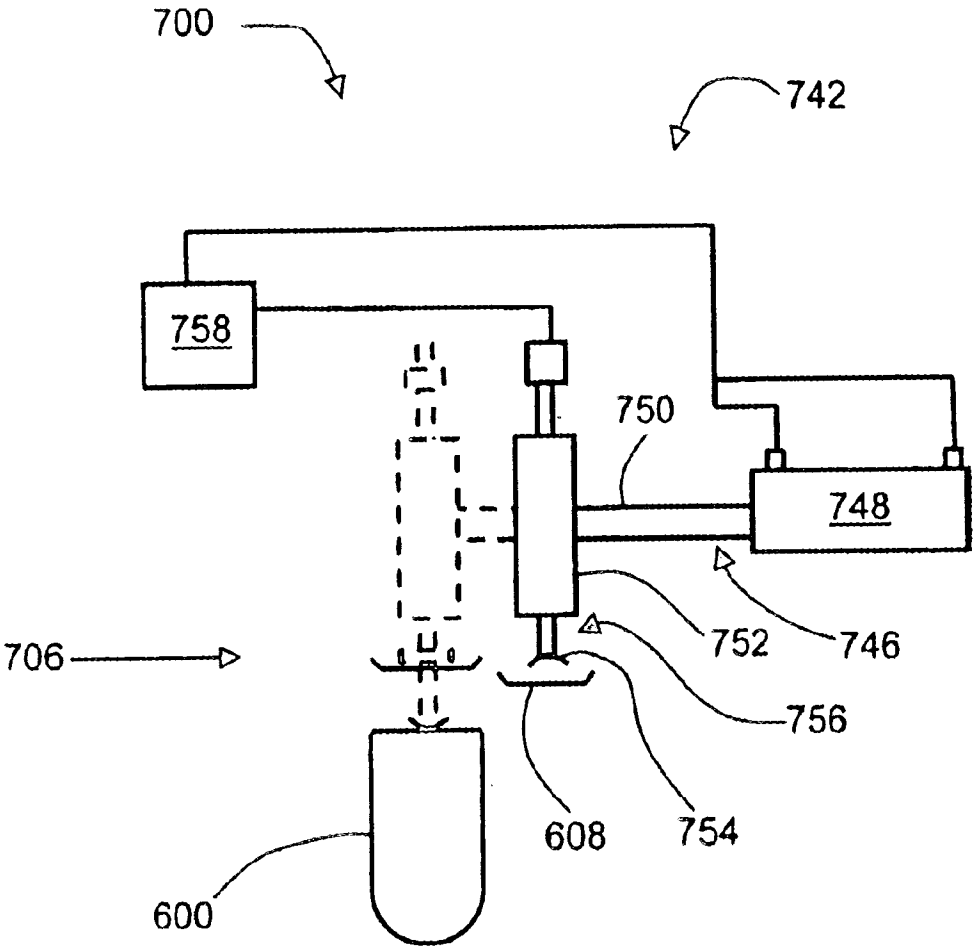
FIG. 14 is a schematic of an exemplary embodiment of a capping station.

FIGS. 12, 13 and 14 illustrate an exemplary embodiment of a container processor 700. The container processor 700 processes containers 600, such that the containers 600 can be captured, filled, and caped and provided for loading into the delivery system. At least three stations are included in the container processor 700, a collection station 702, a filling station 704 and a capping station 706. With reference to FIG. 12, the collection station 702 includes a stack of containers (or stack) 708 positioned for a retractor 710 (shown in an exploded view), having a retention means, such as an air suction cup 712 coupled to an extension rod 714 to position and contact and retract a container 600 from the stack 708. The air suction cup 712 can be vacuum operated being coupled to a vacuum source 716. A rotary rack 718 is rotatably mounted to a shaft 720 and having a container holding means (or container holder) 722, such as multiple circular bores in a planar disc. The rotary rack 718 can include a first plate 724 and a second plate 726 mounted substantially parallel on the shaft 720. A set of bearings 728 can be coupled to the shaft 720 for supporting and rotating the first plate 724 and the second plate 726. The container holders 722 can be disposed on the first plate 724. The rotary rack 718 can be provided to rotationally transport and guide the containers 600 to another station for filling and another station for capping the containers 600 (See FIGS. 13 and 14).

Now referring to FIG. 13, the filling station 704 is shown having a filling tube 730 having a filling control means 732 (e.g., a valve for fluids or a gate for solids) coupled with a filling means 734 (e.g., a pump, a hopper, and a conveyor) coupled to a source of material 736 (e.g., a water tank, a silo) to be loaded into the container 600. A variety of means can be deployed to fill the container depending on the material to be placed into the container. The filling tube 730 can be replaced with a seedling handler that places seedling trees into the container. A seed dispenser can be used. A combination of material handlers can also be deployed. A conduit 728 can operatively couple the source of material 736, filling means 734 and filling tube 730. A trap door 740 is flexibly coupled to the second plate 726 via a hinge 741 to allow for release of the container 600. The container 600 can be deposited into the guide chute 408 or gravity feeder of the reloader 130 (see FIGS. 9 and 10).

A capping station 706, shown with a solid view and a ghost view in FIG. 14 to depict a change in position, can include a capper 742 that picks up lids 608 from a stack of lids and then presses the lids onto the container 600. The capper includes a positioner 746 that includes an actuator 748 operatively coupled to a rod 750 having a vacuum operated arm (or arm) 752 with a suction member 754 at a distal end 756 thereof. A vacuum means 758 can be operatively coupled to the capper to provide a motive force of operation. A variety of actuators can be used and are not limited to the pneumatic cylinders and pistons shown.

The container processor 700 can be mountable to the chamber 212 for automated filling and loading of the empty containers to become filled and capped containers to be loaded into the delivery system. Other forms of container processing can be deployed and tailored to the specific type of container and for the specific type of material to be delivered.

Figure 15:
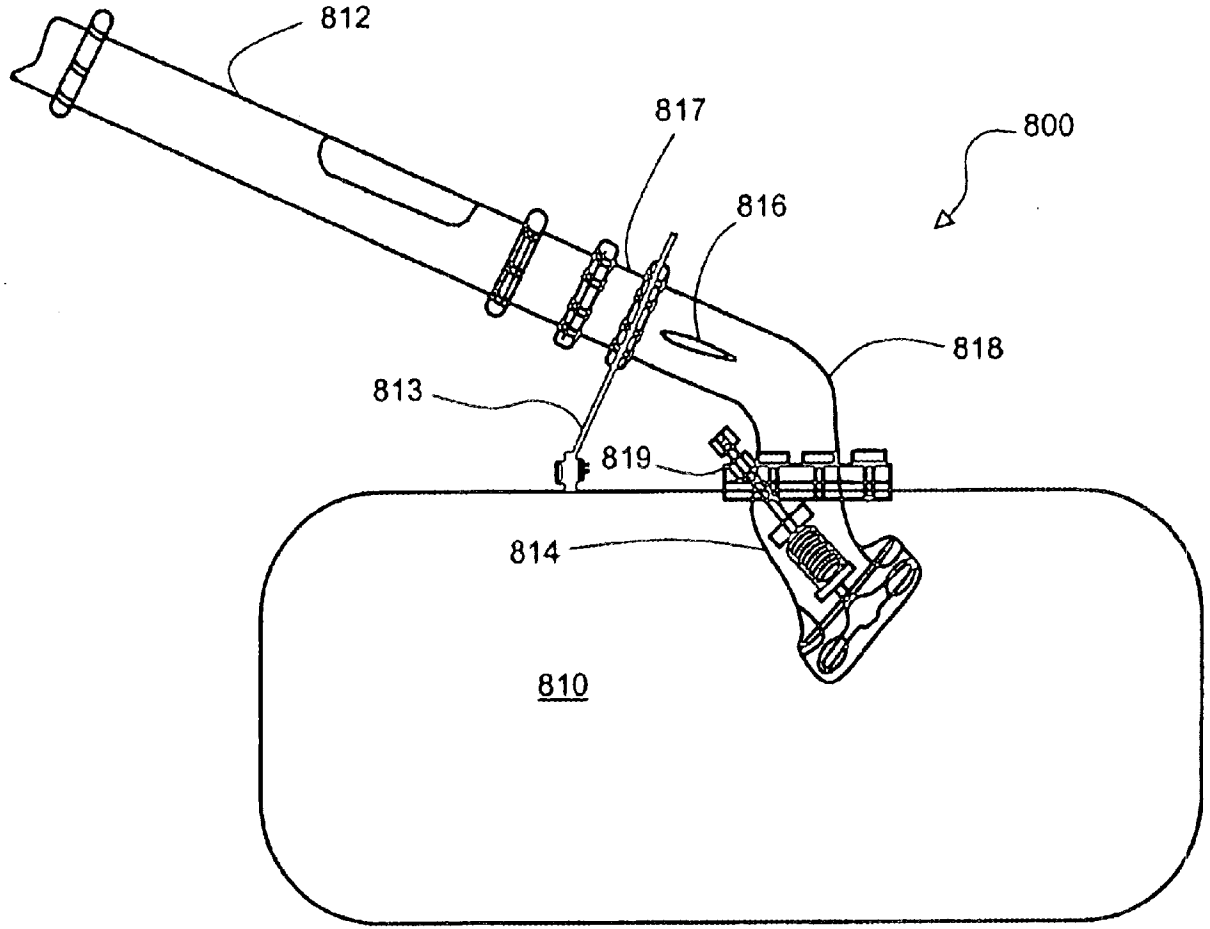
FIG. 15 an exemplary embodiment of valve mechanism is illustrated.

Referring now to FIG. 15., an exemplary embodiment of valve mechanism is illustrated. The valve mechanism 800 is shown mounted to an air tank 810. The air tank, in an exemplary embodiment, can be 28 inches in diameter by 58 inches in length. A barrel 812 is mounted to the air tank 810. The barrel 812 can have a 5 inch outside diameter and a 4 inch inside diameter and be about 42 inches in length with the option of adding more lengths of barrel by flanged connection. A brace 813 can be mounted on the air tank 810 to support the barrel 812. A main valve 814 is disposed in the air tank 810 proximate to the barrel 812. The main valve 814 can be a fast actuating lifting valve similar to the style used in internal combustion engines for intake and discharge valves. In a preferred exemplary embodiment, the main valve is a 6 inch valve that opens inward and is biased closed. The main valve is shown in FIG. 15 without a valve actuator. The assembly of barrel 812, main valve 814, and air tank 810 are shown in a bolted flanged arrangement. It is contemplated that welded construction and a combination of welded and bolted flanges are also employed. A turning vane 816 or multiple turning vanes can be installed in the pipe proximate to the main valve 814 and preferably down stream from an elbow 818. The turning vane 816 reduces the turbulence in the air stream as the high-pressure air is discharged from the air tank 810 and flows past the main valve 814. The turning vane 816 improves the delivery of the projectile (not shown). The elbow 818 can have a 6 inch diameter in a preferred exemplary embodiment. A reducer 817 can be employed to transition from the elbow 818 to the barrel 812. A seal 819 is located on the main valve 814 to prevent air leakage.

Figure 16:
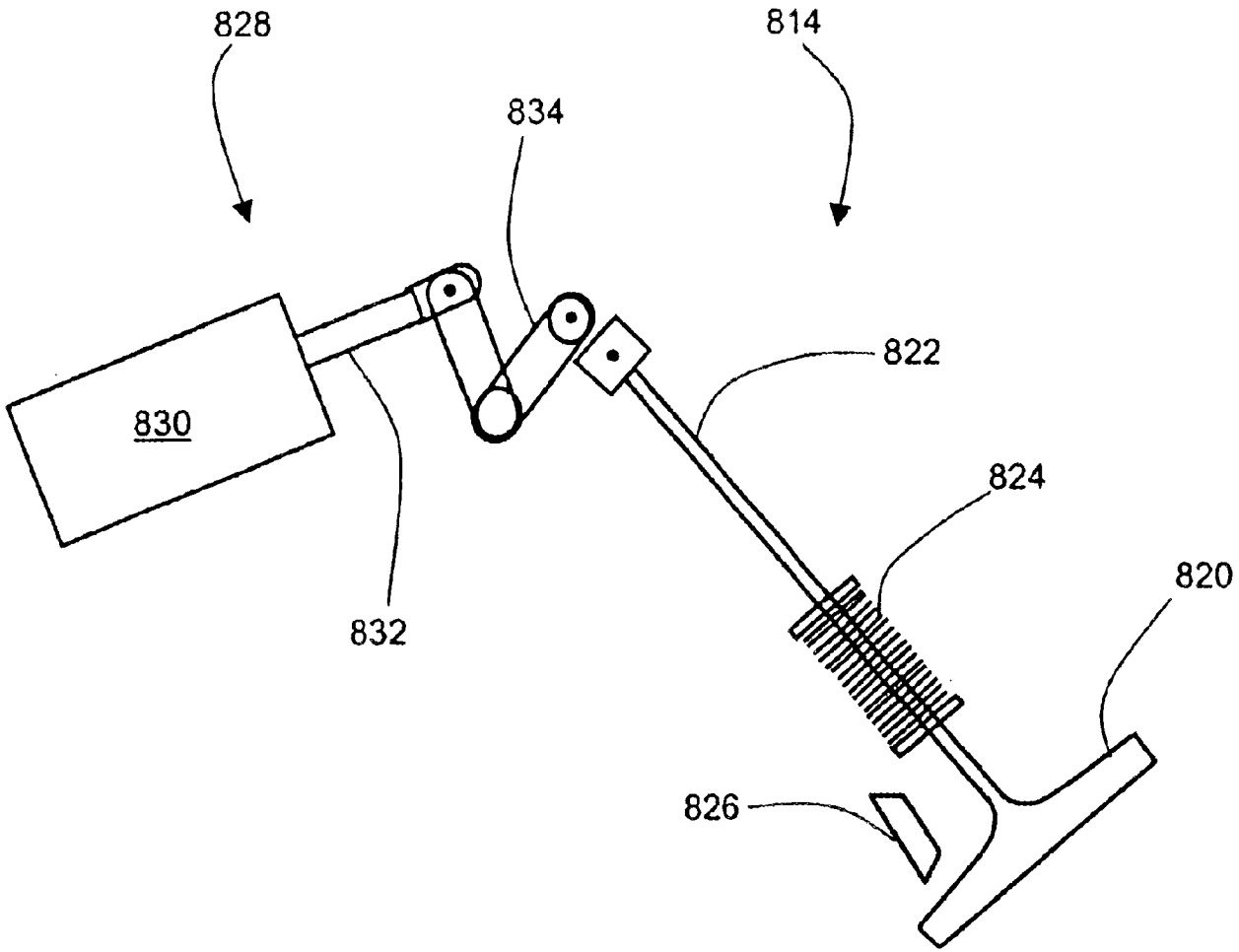
FIG. 16 illustrates an exemplary main valve and actuator.

FIG. 16 illustrates an exemplary main valve and actuator. The main valve 814 includes a valve disc 820 at an end of a valve stem 822 and biasing member 824 disposed over the valve stem 822. In a preferred exemplary embodiment, the biasing member is a spring. A valve seat 826 is partially shown to define the relationship of the components. The valve actuator 828 is shown distal from the valve disc 820 at an end of the valve stem 822. The valve actuator 828 includes a pneumatic piston/cylinder 830 having a drive rod 832. The pneumatic piston/cylinder 830 drives the drive rod 832. The drive rod 832 drives an actuator arm 834 that can include more than one hinged linkage. The actuator arm 834 directly drives the valve stem 822 to unseat the valve disc 820 from the valve seat 826 in an open position. The biasing member 824 drives the valve disc 820 toward the valve seat 826 to seat the valve disc in a closed position. In this exemplary embodiment, the main valve 814 can cycle opened and closed about sixty times in one minute. This valve mechanism 800 can efficiently operate to provide the pneumatic delivery system with a high rate of discharge and low failure rate.

Figure 17:
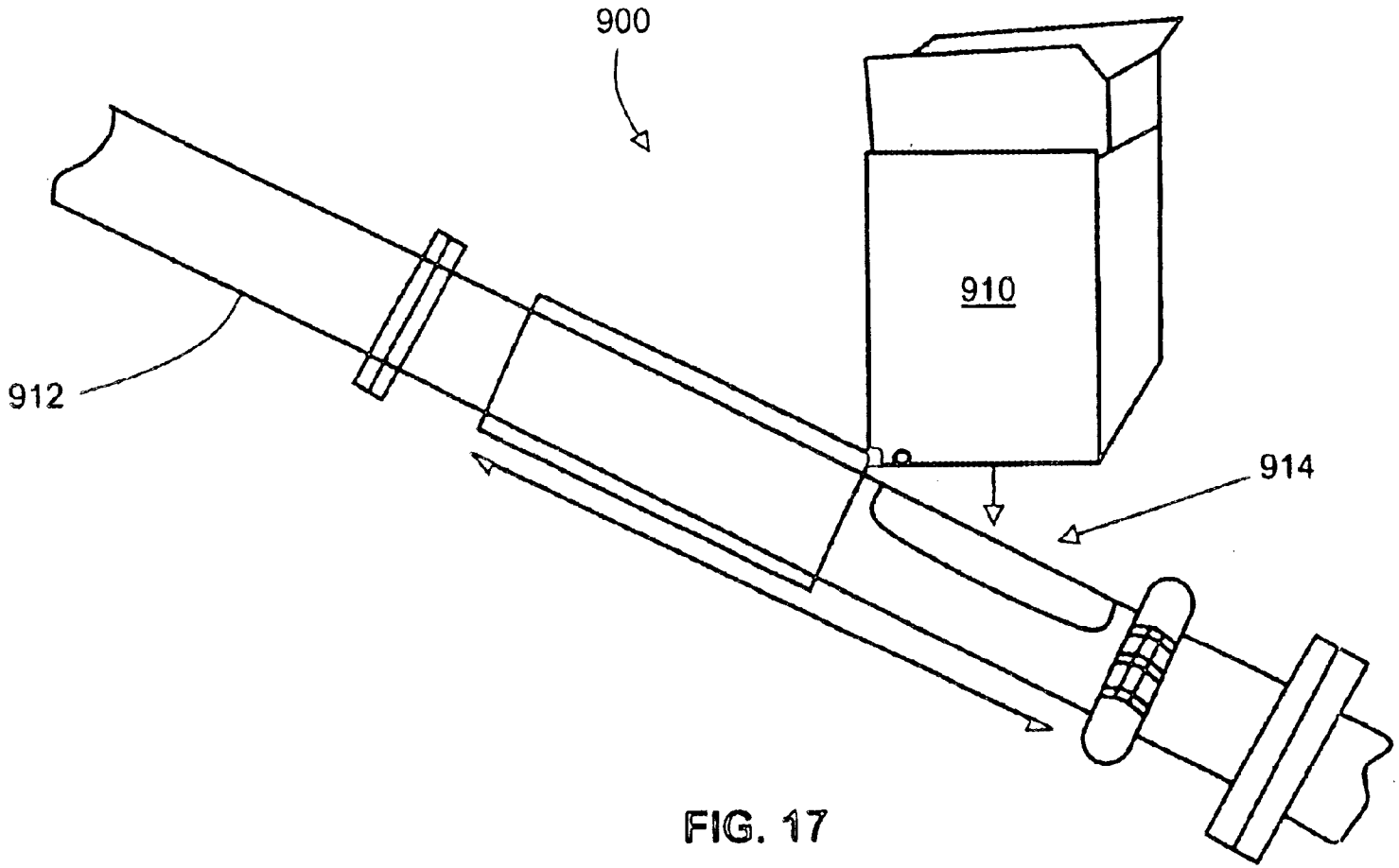
FIG. 17 is a schematic of an exemplary loading mechanism.
Figure 18:
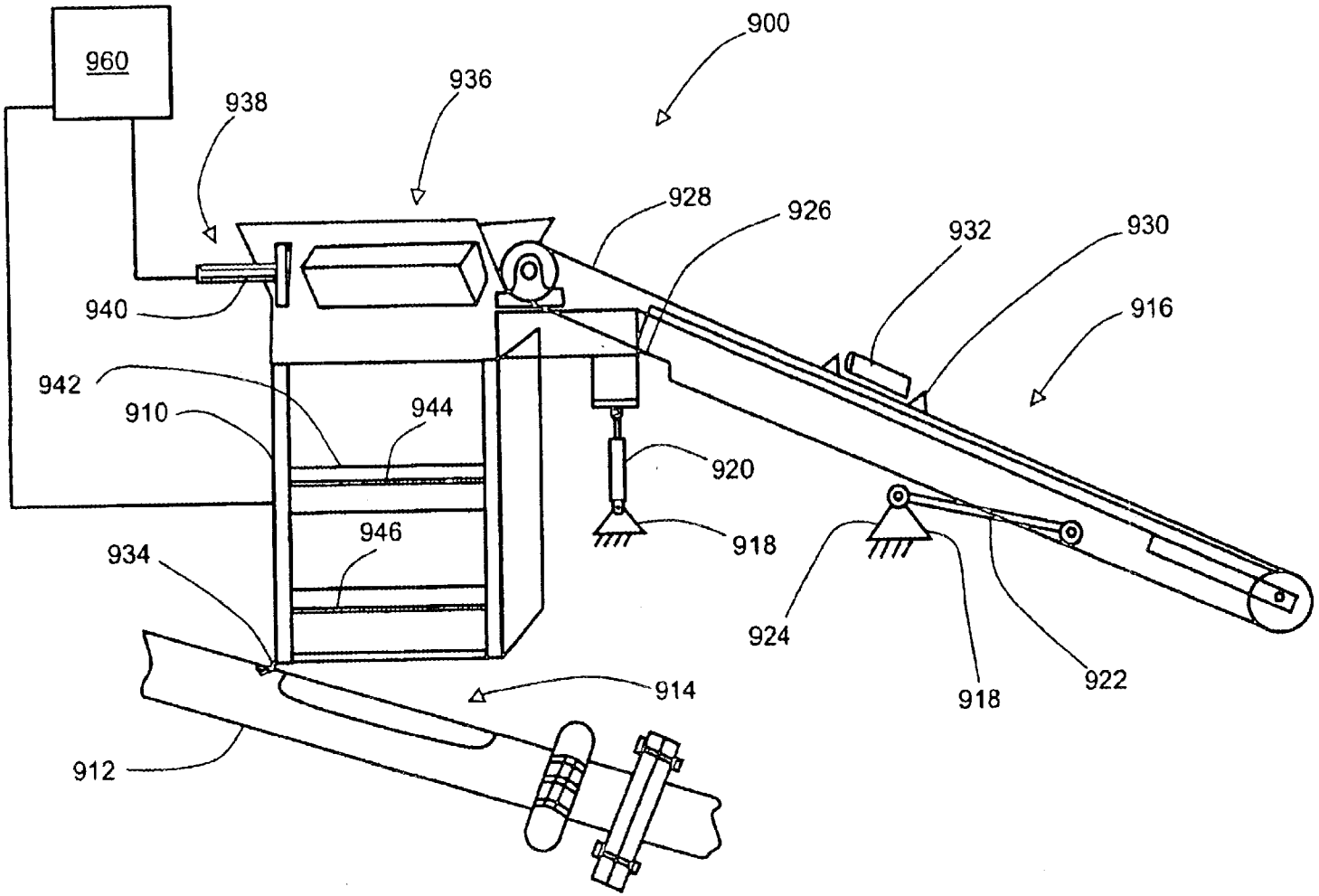
FIG. 18 is a schematic of an exemplary loading mechanism.

Referring to FIGS. 17 and 18, an exemplary loading mechanism 900 is illustrated. A loader 910 is rotatably coupled to the barrel 912 proximate to the chamber 914. The loading mechanism 900 includes a conveyor 916 operatively coupled to the loader 910. The conveyor 916 and the loader 910 are pivotally mounted to the barrel 912 and/or a chassis 918. As the barrel 912 is elevated, the loader 910 and the conveyor 916 can maintain a relatively level orientation with respect to earth gravity. Maintaining a substantially level orientation with respect to gravity allows for the loader 910 and the conveyor 916 to handle the materials, such as a projectile, without jamming. Adjustable supports 920, 922 couple the loader 910 and the conveyor 916 to the chassis 918. The adjustable support 920, 922 can be hydraulic piston and rod mechanisms, spring and rod mechanisms, and the like. As the barrel 912 is elevated, the adjustable supports 920 adjust the orientation of the loader 910 and the conveyor 916. In a preferred exemplary embodiment, the adjustable supports are hydraulic cylinders of one and one half inch diameter, that adjusts to properly orient the loader 910 and conveyor 916. The adjustable support 922 can be a rod pivoted on the air tank 924 and pivoted on the conveyor 916.

The conveyor 916 is rotatably coupled to the loader 910 at a hinge point 926. The conveyor 916 can include a belt 928 fitted with cleats 930 of rubber for conveying (projectiles) containers 932.

The loader 910 is rotatably coupled to the barrel 912 about a hinge point 934. The loader 910 includes an inlet hopper 936 that receives the containers 930 from the conveyor 916. A container stop 938 receives the containers 930 and absorbs any excess forces so that the container 930 is properly received in the inlet hopper 936. The container stop 938 can be biased by a biasing member 940. An internal hopper 942 is located internally to the loader 910 for cueing the containers 930 in a coordinated sequence. In a preferred exemplary embodiment, the internal hopper 942 can hold six containers 930 and sequentially release one at a time into the chamber 914. The internal hopper 942 includes a first stop 944 above a second stop 946 arranged to hold and sequentially release the containers 930 into the chamber 914. A controller 960 can be operatively coupled to the loader 910 for proper timing of the supply of containers 930 to the chamber 914. The controller can also be operatively coupled to the chamber cover actuator (not shown) for a synchronized delivery of containers 930 to a targeted area. In a preferred exemplary embodiment, an Allen-Bradley brand MicroLogix™ controls system can be employed. Although not shown, a container feed mechanism such as a feed hopper can deliver a supply of containers 930 to the conveyor 916 for continuous delivery of containers 930.

Figure 19:
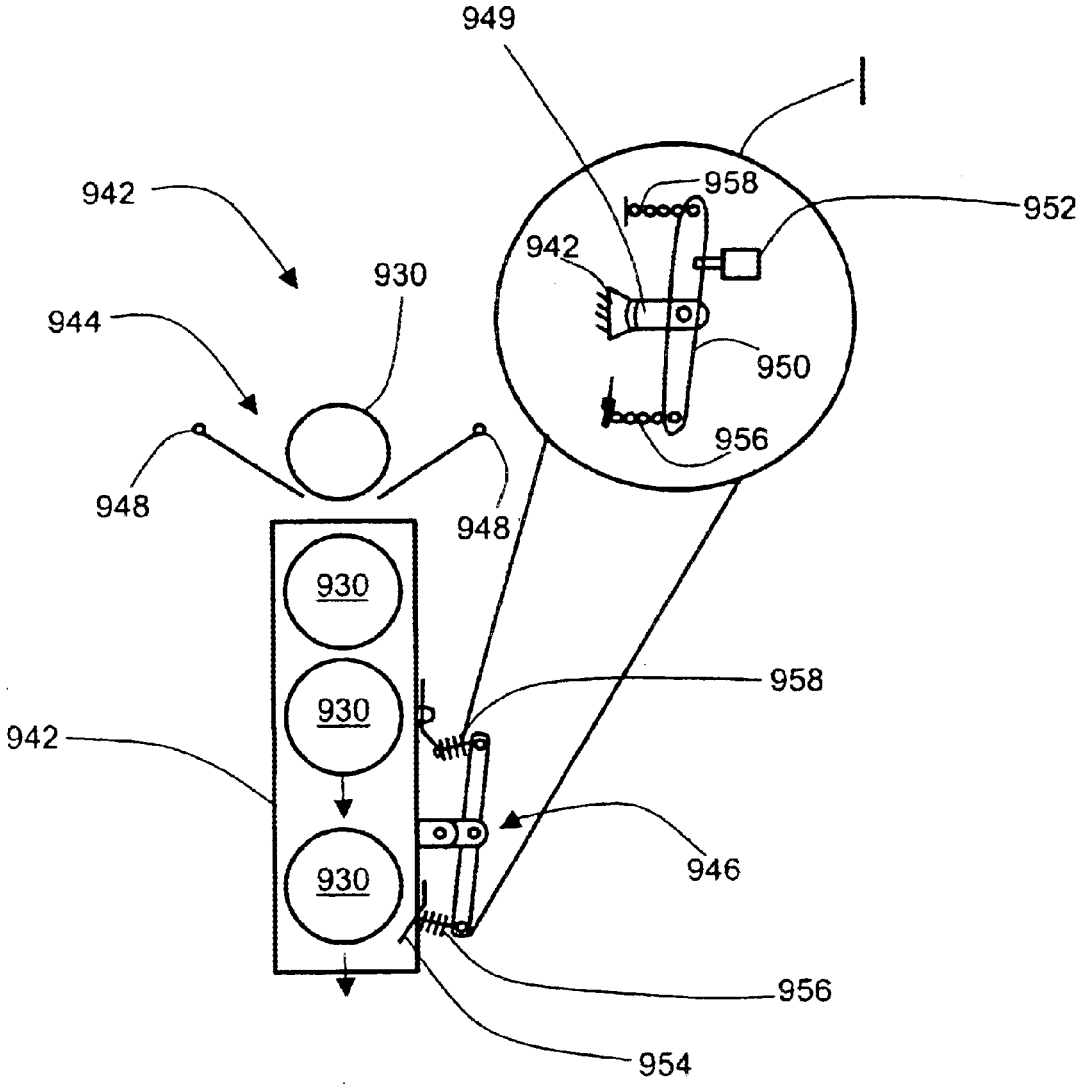
FIG. 19 is a schematic of an exemplary internal hopper.

FIG. 19 illustrates an exemplary internal hopper 942, including an enlarged view of the second stop 946. The internal hopper 942 includes the first stop 944 that is hinged about a hinge point 948. The first stop 944 holds or delays the container 930. The second stop 946 shown enlarged in circle 1, includes a mount 949 coupled to the internal hopper 942. A pivot arm 950 is pivotally coupled to the mount 949. An air cylinder 952 is operatively coupled to the pivot arm 950 for translating the pivot arm 950. The pivot arm 950 is coupled to a stop 954 that holds the container 930 until time of release. A first biasing member 956 is coupled to the pivot arm proximate to the stop 954 and a second biasing member 958 is coupled to the pivot arm 950 opposite the first biasing member 956. The first biasing member 956 and the second biasing member 958 operate to maintain the pivot arm 950 in cooperation with the air cylinder 952 during translation of the pivot arm 950 and while at a rest position. The first biasing member 956 and the second biasing member 958 also maintain the container 930 stationary until time to release the container 930.

The pneumatic delivery system has many useful applications. In one exemplary embodiment, the delivery system can be used to launch containers of flame retardant material of various mixtures. The flame retardant can be applied to surfaces of objects that require protection from fire. Trees in the forest, buildings, and homes that may be exposed to fire can be coated with the flame retardant delivered from the delivery system at long distances.

Another exemplary embodiment is similar to the fire retardant technique. Fire suppressant can also be launched and delivered to locations that require fire suppression. Any variety of fire suppressant can be employed such as water, borax mixture and the like. The delivery system can deliver either liquid or solid forms of fire suppressant. The delivery system can deliver the fire suppressant to any location. In rugged terrain where conventional fire apparatus are limited in use, the delivery system can provide the necessary volume of material to the location. Mountainous regions are just one such location.

Another exemplary embodiment of the delivery system is for irrigation and fertilization of areas for the promotion of plant growth. The delivery system can provide water and any variety of fertilizers to areas such as agricultural fields, farmland, cultivated open land and the like. The fertilizer can be in the form of liquid or solids or even gas. Similar to the above exemplary embodiment is the use of the delivery system for pest control. The delivery system can deliver pest control substances to areas at a distance.

Yet another exemplary embodiment of the delivery system is for use in reforestation. The delivery system can be employed to deliver seedlings to areas requiring reforestation. The projectiles such as containers can be filled with seedlings and/or seedlings and fertilizer and plant growth enhancing materials. The projectiles can be launched to areas in rapid fashion as compared to conventional human planting means. The projectile can be a frangible biodegradable material that breaks up and promotes growth. The projectile can be fashioned to penetrate the soil surface for the promotion of root growth and tree stability and the prevention of "J" or "L" rooting. Moisture can be provided with the projectile or even in via additional projectiles filled with water launched in alternating fashion for the promotion of growth. The adequate spacing can be provided based on the species of the tree and the terrain.

Still another exemplary embodiment of the delivery system is for soil erosion control. The projectile can be made of material suitable for erosion control that disperses over the area to be controlled. The contents such as seed and fertilizer mixed can be delivered. Materials for preventing soil erosion can be contained and delivered to areas that require protection.

Another exemplary embodiment of the delivery system is for oil spill mitigation. The delivery system can deliver substances such as dispersants, bioremedients, absorbents and the like to oil spills.

Another exemplary embodiment of the delivery system is for delivering sensors and testing equipment to locations that are remote or inaccessible. Tornados, volcanoes and hazardous areas and the like are a few examples.

Another exemplary embodiment of the delivery system is for delivery of markers. Visual and audio marker to name a few can be delivered to remote areas such as snow covered mountains for the purposes of identifying areas of concern or warning systems or further delivery of additional projectiles.

Another exemplary embodiment of the delivery system is for delivering life saving elements to remote areas. An example is the delivery of supplies or medical equipment to stranded individuals in a canyon or on a mountain.

Another exemplary embodiment of the delivery system is for anti-terror, anti-riot purposes. The delivery system can be used to deliver neutralizing agents and or antidotes in response to the release of biological agents, being airborne, water borne or landed. Riot control agents, such as tear gas, can be effectively delivered by use of the delivery system.

Finally, treatment of water systems such as reservoirs and lakes can be accomplished with the delivery system. The projectiles can have water treatment compositions that can be delivered to regions of large bodies of water from a single location. This can alleviate the need for water vessels especially motor driven, to travel on the body of water.

While the disclosure has been described with reference to exemplary exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the disclosure not be limited to the particular exemplary embodiments disclosed as the best mode contemplated for carrying out the invention, but that the invention will include all embodiments falling within the scope of the appended claims.

What is claimed is:

1. A pneumatic delivery system comprising;

an air tank;

a barrel mounted to said air tank;

a discharge valve coupled to said barrel proximate said air tank, said discharge valve having a discharge valve actuator operatively coupled to said discharge valve;

a chamber disposed in said barrel proximate said discharge valve;

a rotary loader coupled to said chamber distal from said discharge valve;

a reloader coupled to said rotary loader, wherein said reloader provides said rotary loader with projectiles; and a moving mount coupled to said air tank at a base of said air tank; said moving mount including a swivel table having a hinge mounted to said base and an elevator mounted to said base, wherein said elevator and said hinge provides elevation changes for said barrel, said moving mount further including a rotor supporting said swivel table and a carriage supporting said rotor, wherein said rotor provides rotation to said barrel for altering a direction of delivery.

2. The pneumatic delivery device of claim 1 wherein said reloader and said discharge valve actuator are operatively coupled in synchronization for the delivery of said projectile.

3. The pneumatic delivery device of claim 1 further including multiple barrels.

4. The pneumatic delivery device of claim 1 wherein said barrel and said air tank are maneuverable in unison.

* * * * *